United States Patent [19]

Ortmanns et al.

[11] 4,106,709

[45] Aug. 15, 1978

[54] METHOD OF AND APPARATUS FOR SERVING HELICAL COILS WITH A PROTECTIVE BAND

[75] Inventors: Theodor Ortmanns, Simmerath; Heinz Apelt, Roetgen, both of Germany; Helmut Packes, Kettenis, Belgium

[73] Assignee: Otto Junker GmbH, Simmerath, Germany

[21] Appl. No.: 704,781

[22] Filed: Jul. 13, 1976

[30] Foreign Application Priority Data

Jul. 31, 1975 [DE] Fed. Rep. of Germany ..... 2534198

[51] Int. Cl.[2] ..... H01B 13/08; H01F 41/04; B65H 81/02

[52] U.S. Cl. ..... 242/7.03; 242/7.14; 242/7.23; 29/33 E; 29/605; 156/187; 156/188; 156/428; 156/443; 242/7.08

[58] Field of Search ..... 57/10, 15, 3, 160; 242/7.03, 7.02, 7.08, 7.14, 7.23, 7.22, 4 R, 4 B, 4 BE; 29/605, 33 E; 156/172, 185, 187, 188, 190, 192, 428, 431, 432, 443, 446, 543

[56] References Cited

U.S. PATENT DOCUMENTS

| | | | |
|---|---|---|---|
| 2,923,486 | 2/1960 | Betzel, Sr. | 57/10 X |
| 3,616,061 | 10/1971 | Carter | 156/431 |
| 3,789,594 | 2/1974 | Rees | 57/10 |
| 3,851,831 | 12/1974 | Steiner | 57/10 X |
| 3,940,073 | 2/1976 | Haeusler | 242/7.08 |

*Primary Examiner*—Billy S. Taylor

*Attorney, Agent, or Firm*—Michael J. Striker

[57] ABSTRACT

A helical induction coil of large diameter which is to be served with a protective band is suspended from a driving roller having a substantially horizontal axis of rotation so that the coil axis is substantially horizontal. A serving device is supported on the respective convolution to be served and also on immediately adjacent convolutions at the lowermost region of the coil for advancement in the longitudinal direction of the convolutions. Spreading rollers spread the immediately adjacent convolutions from the respective convolution to permit the serving device to advance. The driving roller frictionally entrains the coil and thus rotates the same about the coil axis and the spreading device is advanced at the same speed as but in the opposite direction than the respective convolution so that the position of the serving device diametrally opposite to the driving roller relative to the coil is maintained. The serving device includes a housing and a serving ring driven into rotation about the respective convolution and carrying a payout reel for a protective band for shared rotation with the serving ring and for individual rotation about an axis of rotation of the serving ring. The serving device further includes a carriage on which the housing is mounted and on which a plurality of driving, support and guiding rollers which contact the respective convolution and the immediately adjacent convolutions is supported. The serving device includes a plurality of interchangeable units so that the serving device can be adapted to induction coils of different diameters.

43 Claims, 8 Drawing Figures

METHOD OF AND APPARATUS FOR SERVING HELICAL COILS WITH A PROTECTIVE BAND

BACKGROUND OF THE INVENTION

The present invention relates to a method of serving induction coils with protective bands, as well as to an apparatus for accomplishing the method.

The principle of electrical induction heating is very well known, and electrical induction heating has found a widespread application in various fields of human endeavor, among others also in foundries. So, for instance, in the latter field, electrical induction coils may be used in crucible furnaces in which the induction coil is incorporated into the walls of the furnace which defines the chamber in which the metal is to be melted, heated and/or otherwise treated. Inasmuch as such crucible furnaces have substantial dimensions it will be appreciated that the induction coil used in such a furnace will also have substantial dimensions. So, for instance, such an induction coil may have an axial length of up to or even more than 2 meters, and may consist of more than sixteen convolutions, depending on the circumstances and on the design requirements. It is well known that the individual convolutions of the induction coil ought to be provided with a protective layer, particularly for the purpose of electrical insulation. For this purpose it is already known to serve the convolutions of the induction coil with a protective band which is wrapped around the convolutions of the induction coil in a helical manner and in one or more layers. In either event, a single band can be served upon the convolutions, or a plurality of such protective bands either of the same material and properties or of different materials and properties. When the desired goal is electrical insulation of the convolutions of the induction coil, it is advantageous to use a band of fiber glass fabric.

The method of serving the protective band or bands onto the convolutions of the induction coil which is prevelant today consists of manually wrapping the band about the convolutions, which is considerably time-consuming and, consequently, expensive owing to the high cost of the labor involved. The factors which make this manual procedure very costly are the substantial dimensions of the induction coil, the fact that the induction coil consists of a plurality of adjoining convolutions which form a continuous helix, and that the induction coil is usually formed by winding the profiled element having a substantial cross section, possibly of tubular configuration, into the helical shape of the induction coil. The material of the induction coil is electrically conductive and, more often than not, consists of copper or of an alloy including a substantial proportion of copper. The individual convolutions of the induction coil are usually closely adjacent to one another in the axial direction of the induction coil.

There is already known a method of and an apparatus for wrapping a protective band around annular or toroidal bodies of different shapes and serving various purposes. One conventional apparatus for performing this conventional method includes an automatic or a semi-automatic serving machine which includes a bench and a split housing mounted on the bench, a split serving ring being mounted in the split housing for rotation about the respective annular or toroidal body to be provided with the protective layer. The body is introduced into the housing and into the serving ring through the split portion of the housing and through the split portion of the ring. In this known apparatus the slot through which the body is introduced faces toward the bench. The serving ring supports a payout reel or roll accommodating the band of protective material, the reel rotating together with the serving ring about the portion of the body to which the band is to be applied, and also revolving about its own axis as the protective band is payed out. Attempts have already been made to use such an apparatus for serving the protective tape onto the convolutions of an induction coil or to modify this existing apparatus so as to be capable of serving the protective band on such convolutions of the induction coil. However, such attempts have met only with a limited success and the modifications were too extensive and expensive. One of the main problems with this modified apparatus was that it required relatively complicated guiding systems by means of which the adjacent convolutions of the induction coil were, in continuous succession, first axially spread away from one another and, subsequent to the winding operation, against pressed axially toward one another, during the relative rotation and simultaneous axial displacement of the induction coil with respect to the housing of the serving apparatus which was arranged stationarily in a vertical plane. An additional problem encountered in serving the protective band onto the convolutions of a helical induction coil, as compared to serving the band on simple annular or toroidal bodies, resides in the fact that the induction coil is equipped with electrical terminals and also, in the region of each third or fourth convolution, with projecting outlet nipples for the introduction and withdrawal of a cooling medium to and from the interior of the induction coil for the purpose of cooling the coil during the operation thereof. These terminals and nipples extend a substantial distance radially outwardly from the outer periphery of the respective convolution and they represent a considerable obstruction to the faultless performance of the serving operation. First of all, such radially outstanding portions of the induction coil prevent secure guidance of the convolutions of the coil on the usually horizontally extending bench, and the spatial guidance of the convolutions, or at least make such connection to the bench and such guidance very difficult. However, more importantly, these radially extending portions make it impossible to use stationarily mounted serving housings in which the slots which permit the introduction of the convolution into the interior of the housing are directed toward the bench.

In order to avoid this disadvantage, it would be conceivable to utilize a differently configurated serving housing which would be mounted for infinite adjustment of its position. However, even if the serving apparatus were so modified, this would not simplify to any considerable extent the complicated guidance of the convolutions of the induction coil but, on top of it, it would require an additional guiding arrangement for the infinite displacement of the serving ring housing, which would be at least just as complex.

An additional problem is to be seen in the fact that such an apparatus of a conventional construction would only be economically feasible if it was not tailored to only one predetermined diameter of the induction coil and to one predetermined cross section of the convolutions thereof. In other words, the investment in such apparatus would bring in the desired return only if the apparatus could be adapted in a simple manner to serving the protective band onto the convolutions of differently shaped induction coils. This additional requirement renders the guiding systems, which are complex as it is, even more complicated and, consequently, more expensive.

As a result of all of the above-mentioned problems, the induction coils of this type are presently, as previously, served with the protective band manually, even though it would be desirable to accomplish at least semi-automation of the serving operation, especially for coils having large diameters and a great number of convolutions, particularly in view of the labor and time expenditures which would be saved through the automation or semiautomation of this operation.

SUMMARY OF THE INVENTION

Accordingly, it is a general object of the present invention to avoid the disadvantages of the prior art.

More particularly it is an object of the present invention to provide a method of serving a protective band onto the convolutions of an induction coil which does not possess the disadvantages of the prior art methods.

It is still another object of the present invention to provide a method of serving the band onto the convolutions which achieves excellent results with minimum expenditure.

A concomitant object of the present invention is to provide an apparatus for serving the protective band onto the convolutions of the induction coils which is simple in construction and reliable in operation.

It is yet another object of the present invention to provide an apparatus here under discussion which permits substantial automation of the serving operation.

A further object of the present invention is to provide a serving apparatus which is easily adaptable to induction coils of different dimensions.

In pursuance of these objects and others which will become apparent hereafter, one feature of the present invention resides, briefly stated, in a method of serving helical induction coils of large diameters and including a multitude of axially adjacent convolutions with at least one protective band using a serving device, the method comprising the steps of mounting the induction coil for rotation about a coil axis; supporting a housing of the serving device on an inner surface of a respective convolution to be served and at a lowermost region of the induction coil; setting the induction coil in rotation about the coil axis; rotating a serving ring mounted on the housing about the respective convolution so that a protective tape is paid out from a payout reel mounted on the serving ring and served onto the respective convolution; and advancing the housing, along the respective convolution at substantially the same speed as but in an opposite direction than those of the respective convolution.

As a result of the fact that the induction coil is rotated about its substantially horizontal coil axis, and the housing of the serving device is advanced on the respective convolution, it is possible to dispense with any otherwise necessary complicated and structurally complex guidance of the convolutions during the serving operation. This is particularly true in view of the fact that the method further comprises the step of spreading the convolutions which are immediately axially adjacent to the respective convolution away from the latter to an extent necessary for the advancement of the housing along the respective convolution. Thus, during the advancement of the serving ring housing relative to the respective convolution in the direction opposite to the movement of the respective convolution, the immediately adjacent convolutions are spread away from the respective convolution and kept at the distance necessary for advancement of the housing, as well as subsequently automatically pressed against the convolutions which have been provided with the conductive band previously, in the axial direction of the induction coil. A particular advantage of the method of the present invention is that the induction coils of drastically different diameters and having considerably different numbers of convolutions can be served by the same serving device. This serving device can also be used for serving the protective band onto the convolutions of an induction coil in which each third or fourth convolution is provided with radially projecting nipples or terminals, such as cooling water nipples. When this is to be achieved the housing and the serving ring are so constructed as to have radially extending slots and the method of the present invention then comprises the step of temporarily stopping the rotation of the serving ring in a coextensive position of the slots of the housing and of the serving ring, at the region of the respective radially extending projection of the respective convolution to let the latter pass through the slots during the advancement of the housing past the same.

The method of the present invention can further comprise the step of additionally supporting the housing on the convolutions of the induction coils which are axially adjacent to the respective convolution to thereby avoid angular displacement of the housing about the respective convolution. The coil may be rotated by suspending the coil from frictionally engaging the induction coil with a driving roller. The speed of rotation of the driving roller may be coordinated with the speed of advancement of the housing so that the housing is thereby maintained substantially diametrally opposite to the driving roller during the serving operation.

According to another feature of the present invention, an apparatus for serving helical induction coils of large diameters and including a multitude of axially adjacent convolutions with at least one protective band comprises; a driving roller which is mounted on a support for rotation. The induction coil is suspended from the driving roller. A serving device includes a housing supported on the inner surface of at least a respective one of the convolutions at a region substantially diametrally opposite to the driving roller, for advancement in the longitudinal direction of the respective convolution. The serving device may be equipped with a plurality of support rollers which, on the one hand, render the advancement of the housing possible and, on the other hand, stabilize the serving device on the coil and prevent the housing from relative angular displacement about the respective convolution. Furthermore, additional rollers mounted on the serving device may be used for spreading the immediately axially adjacent convolutions from the respective convolution to thereby permit the advancement of the housing and of the serving device along the respective convolution and between the respective adjacent convolutions, these rollers also achieving subsequent pressing of the already protected convolution against the convolutions which have been provided with the protective layer previously.

The rotational speed of the driving roller and advancement speed of the serving device must not only be coordinated with one another, but must also be so selected as to take into account the permissible serving speed. In either event these speeds are so coordinated with one another that the serving device is always located diametrally opposite to the driving roller when considered relative to the induction coil. It is currently preferred that the housing of the serving device is supported on the inner surface of the respective convolution at a region which is diametrally opposite to the region at which the driving roller contacts such inner surface, and if the housing is advanced at such a speed that the serving operation is performed exactly diametrally opposite to the driving roller, that is, at a region where the tangent to the respective convolution which is to be served with the protective band extends substantially horizontally.

It is not absolutely necessary that the driving motor of the driving roller and the driving arrangement of the serving device be controlled from a common control location as to their speeds since it is possible, as a rule, to so construct the driving arrangements that the above-discussed conditions are satisfied for the entire duration of the serving operation. Of course, the speed ratios must be adjusted, for instance by substituting different set of gears for pervious set of gears of a gear transmission, when an induction coil of different coil diameter from that previously served is to be served with the protective band. This may also be valid for the adaptation of the various guiding and/or support rollers carried by the housing to the various induction coil diameters; however, any other structural adjustments, such as those which would be necessary if an extrenous guiding system were provided for guiding the induction coil, are no longer necessary.

According to a further aspect of the present invention, the driving roller has an axial dimension which at least equals the axial dimension of the induction coil augmented by the corresponding dimension of the housing. This renders it possible for the housing to spread the immediately axially adjacent convolutions of the induction coil away from the respective convolution which then undergoes the serving operation, and subsequently press the immediately previously served or bandaged convolution against the convolutions which have been bandaged before that, without interfering with the proper operation of the driving roller.

The driving roller has a free end remote from the support and an abutment portion thereat which extends radially outwardly beyond the circumferential surface of the driving roller and which prevents the induction coil from slipping off the driving roller. The abutment portion may have a flange-shaped configuration.

The circumferential surface of the driving roller has preferably such properties that the convolutions of the induction coil can slide thereover in the axial direction of the driving roller with a minimum friction, while they are frictionally entrained thereby for circumferential movement with minimum slippage. To achieve this, the driving roller, in a currently preferred embodiment of the invention, includes a roller body and a layer of friction-enhancing material at the external surface of the roller body. The layer may be constituted by a plurality of turns of a tape of the above-mentioned material around the external surface of the driving roller, and the frictionenhancing material may be natural or synthetic rubber and may have Shore hardeness of approximately 60.

The driving roller may be of a cylindrical configuration, and the axis thereof may extend exactly horizontally. However, in certain circumstances, especially when working with large and heavy induction coils, it is preferred to make the driving roller of a substantially frusto-conical configuration, converging toward the end of the driving roller which is remote from the support. As an alternative thereto, the driving roller may be cylindrical and the axis thereof may enclose an acute angle with the horizontal, the end of the driving roller which is remote from the support being lower than the end which is supported by the support. In this manner, the slipping of the convolutions of the induction coil in the axial direction of the driving roller toward the free end of the driving roller is enhanced. Under these circumstances, it is not necessary for the circumferential surface of the driving roller to have different frictional properties in the axial and in the circumferential direction; rather, the material of the circumferential surface may have the same frictional properties in all directions. The inclination of the uppermost generatrix with respect to the horizontal may amount to only a few degrees, which facilitates the slippage of the convolutions, but which does not interfere with the virtually slip-free entrainment of the induction coil in the circumferential direction of the driving roller. The motor which drives the driving roller, as well as the motor which advances the serving device and rotates the serving ring, may be variablespeed motors.

In a currently preferred embodiment of the present invention, the housing is a component part of an advancing carriage which carries a driving motor and supports an advancing roller which is driven into rotation by the above-mentioned motor and which contacts the respective convolution on which the housing is supported. The serving device may further include a control roller opposite the advancing roller across the respective convolution. The above-mentioned motor may also drive the control roller into rotation. The serving device may further include a pair of guiding rollers mounted on the advancing carriage and contacting the respective convolution at axially spaced lateral surfaces thereof. The serving device may further include a guiding carriage located ahead of the housing as considered in the direction of advancement of the serving device relative to the respective convolution, a support roller running on the inner surface of the respective convolution and a pair of additional guiding rollers mounted on the guiding carriage and contacting the respective convolution at axially spaced lateral surfaces thereof.

It is further advantageous if auxiliary support rollers are mounted on the housing for rotation in contact with the convolutions of the induction coil which are immediately axially adjacent to the respective convolution, being operative for preventing angular displacement of the housing about the respective convolution. The serving device may further include a pair of spreading rollers which are mounted on the housing next to the auxiliary support rollers and having vertically extending roller axes, which spreading rollers contact the axial or lateral surfaces of the convolutions of the induction coil which are immediately adjacent to the respective convolution and urge such adjacent convolutions away from the respective convolution. These spreading rollers serve the purpose of averting any damage to the convolutions themselves, or to the protective layer provided thereon. When the diameter of the induction coil is substantial, the present invention also provides for the use of spreading roller pairs instead of the above-mentioned spreading rollers, which pairs are individually arranged to each axial side of the serving device. In this case, the rollers of each spreading roller pair include the respective immediate axially adjacent convolution between themselves so as to obtain positive guidance of such adjacent convolution between the spreading rollers.

The auxiliary support rollers and the spreading rollers are preferably arranged approximately in a plane which is normal to an advancement axis of the housing and passes through the serving ring.

In order to be able to serve the protective band even on induction coils which are equipped with radially extending cooling water nipples and/or electrical terminals, without having to resort to lifting of the serving device from the respective convolution in the region of the radially extending nipples and/or terminals, it is further proposed according to another aspect of the present invention to equip the serving device with a support lever which is mounted on the housing for displacement and to mount the control roller on the support lever for displacement therewith so that the control roller is opposite to the advancing roller in an extended position, and remote from a respective convolution in the retracted position of the lever. Advantageously the serving device further includes at least one spring which urges the lever toward the extended position thereof, the lever being mounted on the serving device for pivoting about a substantially vertical axis. As mentioned previously, the housing has a downwardly opened elongated slot, and the lever has a portion which closes the open lower end of the slot in the extended position, and opens the same in the retracted position.

The advancing roller, similarly to the driving roller, may also be provided with at least a layer of friction-enhancing material at least at the outer circumfertial surface thereof, in order to assure a faultless advancement of the serving device at a speed which is coordinated with the rotational speed of the induction coil. Here again, the advancing roller may be made of such material in its entirety, or it may be provided with a layer of the friction-enhancing material at least at its outer circumferential surface, the layer being possibly constituted by turns of a tape of the friction-enhancing material. Again, the friction-enhancing material may be a natural or synthetic rubber or a similar synthetic plastic material having a Shore hardness of approximately 60. The driving means for the serving ring may include an endless belt which is trained about the outer periphery of the serving ring. The serving device further includes at least one payout reel which is mounted on the serving ring for shared rotation therewith about the convolution and also for individual rotation about a support axis which is radially offset from the convolution, the payout reel accommodating a supply of further protective band. The serving device may further include at least one auxiliary guiding roller which is mounted on the serving ring for shared rotation therewith about the convolution and which cooperates with the payout reel to guide the protective band onto the respective convolution.

The serving device may further comprise an additional payout reel and at least one additional auxiliary guiding roller similar to the above-mentioned payout reel and to the above-mentioned auxiliary guiding roller, respectively and mounted on the serving ring in a similar manner at the same axial side thereof but circumferentially offset from the above-mentioned payout reel and the above-mentioned auxiliary guiding roller through 180° about the advancement axis.

According to a further concept of the present invention, the serving device may further include an additional housing similar to the above-mentioned housing and, an additional serving ring similar to the above-mentioned serving ring, the housing and the additional housing being arranged in series as considered in the direction of advancement of the serving device relative to the respective convolution, the above-mentioned payout reel being arranged at an axial side of the above-mentioned serving ring which faces away from the additional serving ring, and the additional payout reel is arranged at a side of the additional serving ring which faces away from the above-mentioned serving ring, the payout reels accommodating respective supplies of protective bands. Whether the payout reels are arranged on one or on two separate serving rings, the protective bands accommodated thereon may be of the same material, or they may be of different materials. Even when the payout reels are arranged at sides of the separate serving rings which face away from one another, these payout reels can be still circumferentially spaced from one another through 180° about the respective convolution. This assures a better dynamic behavior of the serving rings, results in a more quiet and uniform rotation thereof, and in reduced frequency and/or amplitude of resulting oscillations.

The endless belt which is trained about the periphery of the respective serving ring, or both of the endless belts which are associated with the two serving rings, and the advancing roller may be synchronously driven by a common motor. As already mentioned before, the common driving motor may be speed-variable or speed-adjustable.

When the rotation of the driving roller and the advancing speed of the seving device are coordinated with one another in such a manner that the driving roller and the serving device maintain the relative positions thereof with respect to one another, diametrally opposite to each other across the induction coil, for a given coil diameter, it is not necessary to resort to variation of the speeds of the two above-mentioned motors. However, it is advantageous even under these circumstances to interpose between the driving motor of the serving device and the advancing roller a train of easily exchangeable gear wheels, the ratios of which correspond to the respective advancement speed of the serving device. Preferably, such train inclues respective interchangeably mounted gear pairs so that a substitution of one gear pair for another results in a different speed of advancement of the serving device by providing a different transmission ratio between the output shaft of the driving motor and the advancing roller. In this manner, the speed of advancement of the serving device can be adapted to correspond to the serving speed onto induction coils of different diameters.

In either event, a particular advantage of the present invention is to be seen in the fact that the serving device is constituted by a plurality of discrete units, including a housing unit, at least one carriage unit and other units of different dimensions which are adapted to be interconnected with one another to form with each other a respective serving device of a fitting configuration to the respective induction coil to be served.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
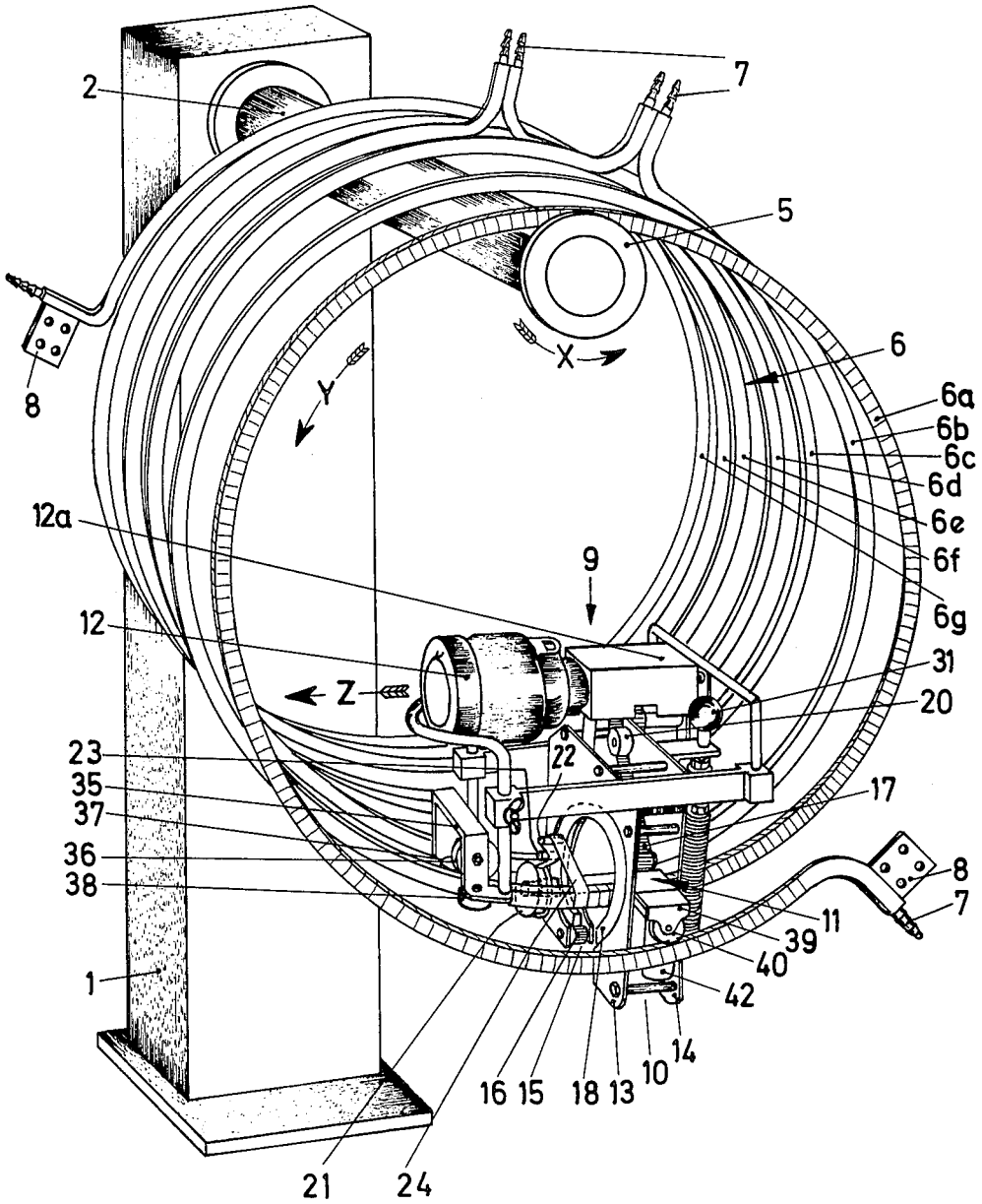
FIG. 1 is a perspective view of the apparatus of the present invention.
Figure 2:
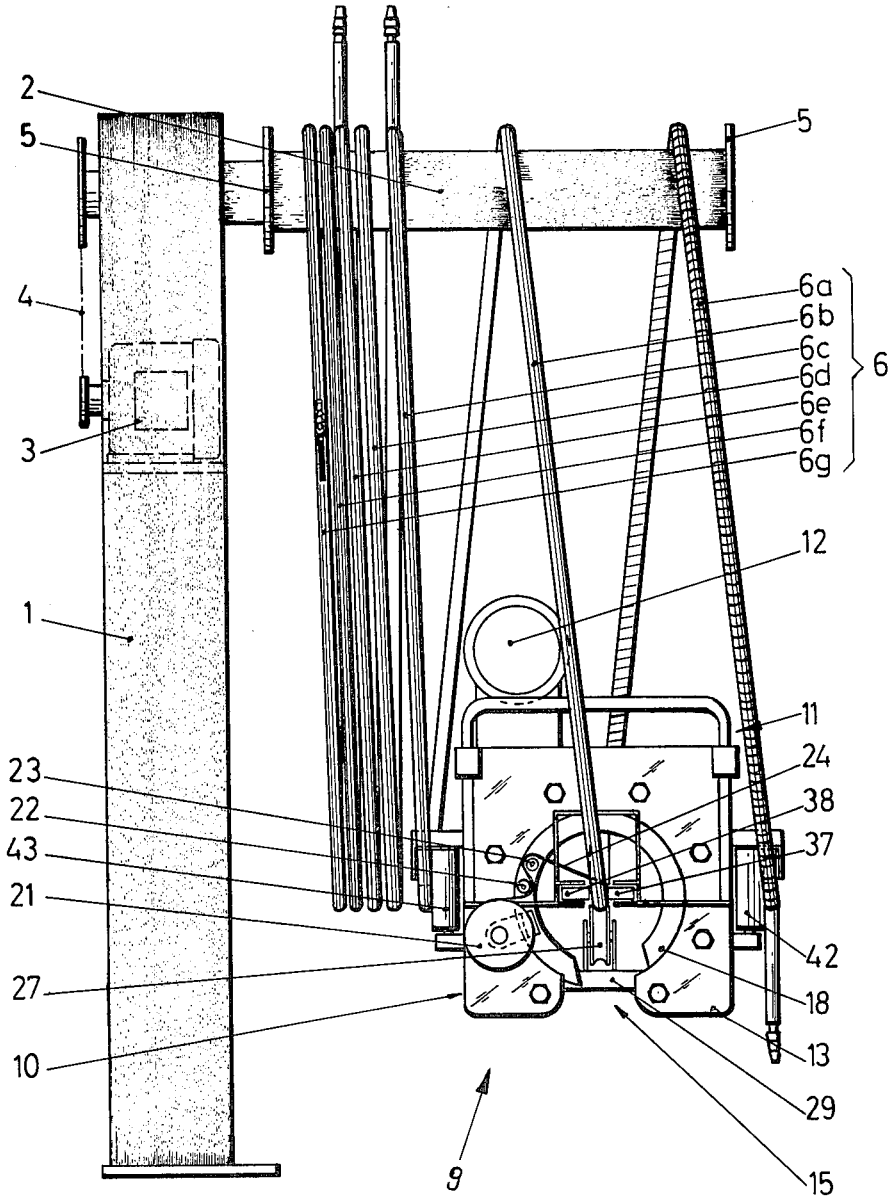
FIG. 2 is a side elevational view of the apparatus of FIG. 1.

Referring now to the drawing in detail and first to FIGS. 1 and 2 thereof, it may be seen that the apparatus of the present invention includes a support 1 of a column-shaped configuration which is stationary relative to the environment. At the upper end of the support 1, there is supported a cylindrical driving roller 2 for rotation about a horizontal axis. The driving roller 2 is set into rotation by means of an electric motor 3, via a transmission 4, for instance, a chain transmission. The electric motor 3 rotates the driving roller 2 in a counterclockwise direction as indicated by an arrow X.

One end of the driving roller 2 is supported on the support 1, and each end of the driving roller 2 has a flange-shaped projection 5.

As may be further seen in FIGS. 1 and 2, the horizontally extending driving roller 2 serves the purpose of suspending a helically convoluted cylindrical induction coil 6 therefrom in such a manner that the longitudinal axis of the coil 6 and the axis of rotation of the driving roller 2 are substantially parallel to one another. The driving roller 2 is provided at its outer circumferential surface with a layer of natural or synthetic rubber or a similar synthetic plastic material having a Shore hardness of approximately 60. The layer may be constituted by a plurality of turns of a tape of the above-mentioned material. Thus, the friction-enhancing outer surface of the driving roller 2 entrains the induction coil 6 due to the friction between the outer circumferential surface of the driving roller 2 and the inner surfaces of the convolutions of the induction coil 6, during the rotation of the driving rollers in the direction of the arrow X, so that the induction coil 6 is rotated about its coil axis in the direction of an arrow Y.

Individual convolutions of the induction coil 6, of which there may be more or less than the number illustrated, are designated with reference numerals 6*a* to 6*g*. The convolutions 6*a* to 6*g* of the induction coil 6 are constituted by a profiled element which has an internal channel for the passage of a cooling medium, such as of cooling water, therethrough. Some of the convolutions 6a to 6g are provided with radially outwardly extending connectors or nipples 7 which serve the purpose of introducing the cooling medium into, and withdrawing the expended cooling medium from, the internal channel of the induction coil 6. Such connectors are usually provided at each third or fourth convolution 6*a*–6*g* of the induction coil 6. The reference numeral 8 indicates an electrical terminal connector which also extends radially outwardly beyond the outer circumference of the induction coil 6.

As can be also further ascertained from FIGS. 1 and 2, a serving device 9 of a basically known construction is supported on the radial inner surface of a respective convolution 6*b* at a region of the induction coil 6 which is diametrally opposite to the region at which the driving roller 2 contacts the inner surface of the convolutions 6*a* to 6*g*, that is, at the lower region of the induction coil 6.

The serving device 9 is constructed as an individually driven and transportable arrangement, and, basically, it includes a housing 10, an advancing carriage 11 connected to the housing 10, and a driving motor 12 with a transmission box 12a which are connected to the carriage 11.

The serving device 9 advances longitudinally of the respective convolution 6*b* and afterwards along the subsequent convolutions, being advanced by its own driving arrangement 12, 12*a*, the direction of advancement of the serving device 9 being indicated by an arrow Z, that is, in a direction opposite to the direction Y of movement of the convolutions 6*a* to 6*g* past the serving device 9. The speed of advancement of the serving device 9, though, corresponds to the speed of movement of the convolutions 6*a* to 6*g* in the direction Y. As a result of this arrangement, the serving device 9 maintains its position diametrally opposite to the driving roller 2, during the serving operation, that is during the rotation of the induction coil 6 about its axis. On the other hand, the serving device 9 conducts a movement axially of the induction coil 6 toward the support 1 as it serves a protective band in succession onto the convolutions 6*a* to 6*g* of the helically convoluted induction coil 6.

The housing 10 basically consists of two bearing plates 13 and 14 which are arranged at a distance from one another, which bearing plates 13 and 14 each have a downwardly open radial slot 15 which has at least such a transverse dimension that the respective convolutions 6a to 6*g* can pass through the slot 15, so that the housing 10 can be introduced upon a respective convolution 6*a* to 6*g* by passing the latter through the slot 15.

Figure 6:
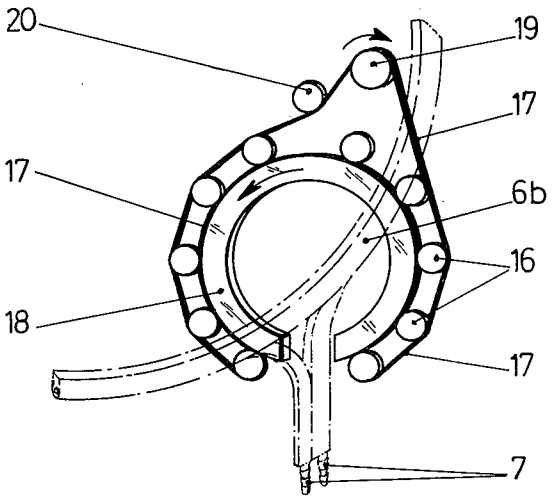
FIG. 6 is a somewhat diagrammatic illustration of a serving ring of the serving device of the apparatus of FIG. 1, also illustrating the support of the serving ring in the serving device.
Figure 5:
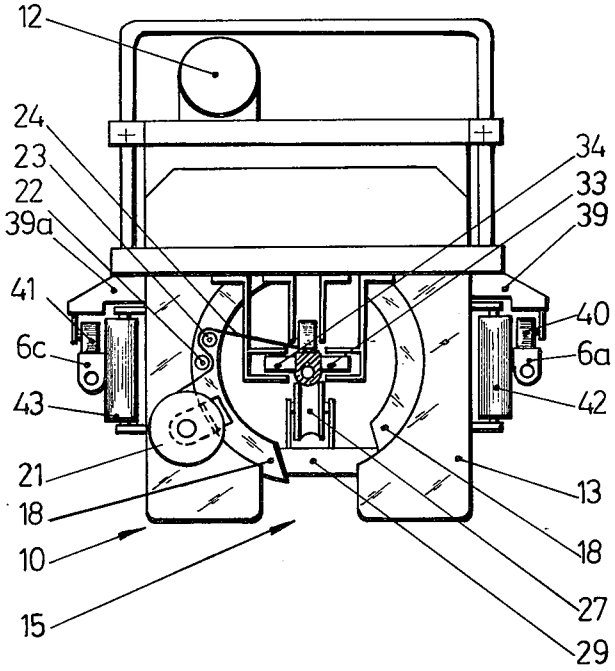
FIG. 5 is a front elevational view of the serving device of the apparatus of FIG. 1.

The two bearing plates 13 and 14 of the housing 10 mainly serve the purpose of carrying a multitude of rollers 16, around which there is trained (compare FIG. 6) an endless driving belt 17 in form of a double loop arranged to both sides of the rollers 16, the inner loop serving the purpose of supporting a serving ring 18 which is also provided with a radially extending slot. As is also clearly indicated in FIG. 6, in a diagrammatic fashion, the radially outwardly extending cooling water connectors 7 of the induction coil 6 can pass through the serving ring 18 when the radial slot thereof is coextensive with the radial slot 15 of the housing 10, with the rotation of the serving ring 18 being terminated. The radial slots of the serving ring 18 and of the housing 10 also serve the purpose of introducing the respective convolution 6*a* to 6*g* into the region of the axis of rotation or advancement axis of the serving ring 18 when the serving device 9 is to be supported on the respective convolutions 6*a* to 6*g*.

The endless driving belt 17 is conducted around a driving roller 19 which is also driven into rotation from the transmission 12*a* and via the same by the driving motor 12. The serving ring 18 is set into rotation, using the driving roller 19 and endless driving belt 17, during the serving operation, while the serving ring 18 as indicated by arrows in FIG. 6, rotates opposite to the direction of rotation of the driving roller 19. The reference numeral 20 in FIG. 6 indicates a tensioning roller which can be biased against the endless driving belt 17 and assures a constant slip-free transmission of the rotary movement between the driving roller 19 and the serving ring 18 via the endless belt 17.

Referring now particularly to the embodiment of the present invention which is illustrated in FIGS. 1 through 5, the serving ring 18 carries on its front side, as considered in the advancement direction Z, a payout reel or roll 21, the reel 21 being mounted on the serving ring 18 for individual rotation about its own axis and also for shared rotation with the serving ring 18 about the advancement axis of the serving device 9 and about the respective convolution 6*b*. In the illustrated embodiment the reel 21 accommodates a supply of a protective band 24 which may, for instance, have electrically insulating properties, such as a glass fiber fabric band. Two guiding or deflecting rollers 22 and 23 are associated with the reel 21, such rollers 22 and 23 also being permanently mounted on the serving ring 18 and also rotating therewith about the advancement axis of the device 9 and about the respective convolution 6*b*.

The housing 10 constitutes a component part of the advancing carriage 11, being connected thereto, for instance, by means of screws or other conventional holding elements.

The advancing carriage 11 is assembled from components or units which are detachably connected to one another in such a manner that the advancing and guiding components of the serving device 9 can be adapted to induction coils 6 of different diameters and to induction coil convolutions having different cross-sectional configurations and dimensions, in a simple manner.

Rearwardly of the housing 10 as considered in the direction Z of advancement of the serving device 9, the advancing carriage 11 is equipped with a driving roller 25 which contacts the inner surface of the immediately previously served convolution 6*b*, the advancing roller 25 being also rotated by the driving motor 12 via the transmission 12*a*. A pair 26 of interchangeable gears serves the purpose of transmitting the motion from the motor 12 to the advancing roller 25, the pair 26 being easily interchangeable by a different pair of a different motion-transmission ratio in that it is freely accessibly mounted at the rear side of the gear box 12*a*. Thus, when it is desired to necessary to change the degree of overlapping of the various turns of the protective tape 24, or to use a band 24 of a different transverse dimension, the pair 26 of gears is substituted by a different pair of gears which is compatible with the desired changed speed relationship.

Figure 4:
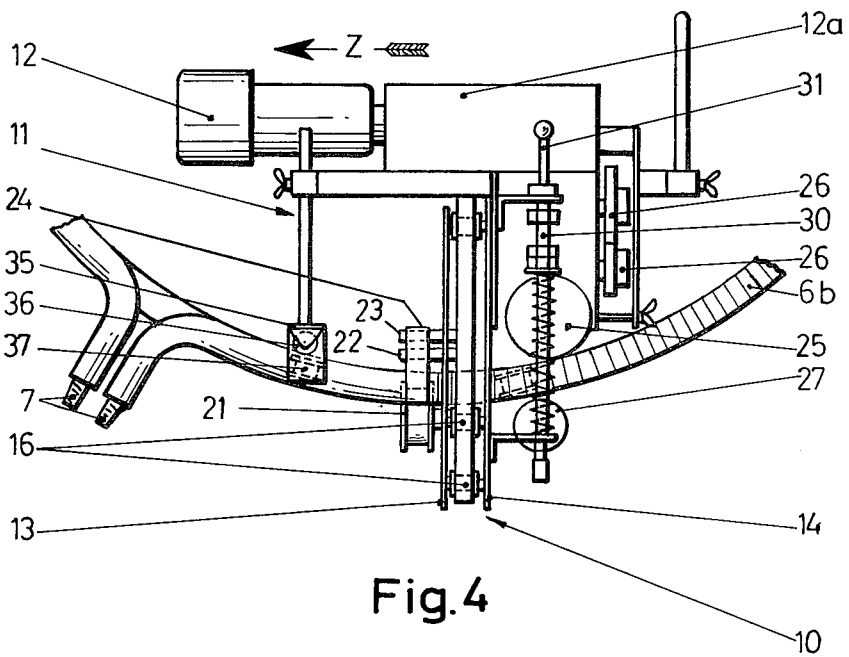
FIG. 4 is a side elevational view of the serving device of the apparatus of FIG. 1.

As may be most clearly seen from FIG. 4, the advancing roller 25 revolves in contact with the inner surface of the already served convolution 6*b* of the induction coil 6. In order to assure a slip-free advancement of the serving device 9, the advancing roller 25 consists of a material having a high coefficient of friction. However, it is also possible and contemplated by the present invention that the advancing roller 25 may have a core of a different material, only a layer of the friction-enhancing material being provided at the outer circumferential surface of the advancing roller 25. The layer may either be continuous, or may be constituted by a plurality of turns of a tape of the friction-enhancing material. A particularly suitable friction-enhancing material is, for instance, natural or synthetic rubber or a synthetic plastic material having the desired properties, the material of the advancing roller 25 or of the outer layer thereof having a Shore hardness of approximately 60.

Figure 3:
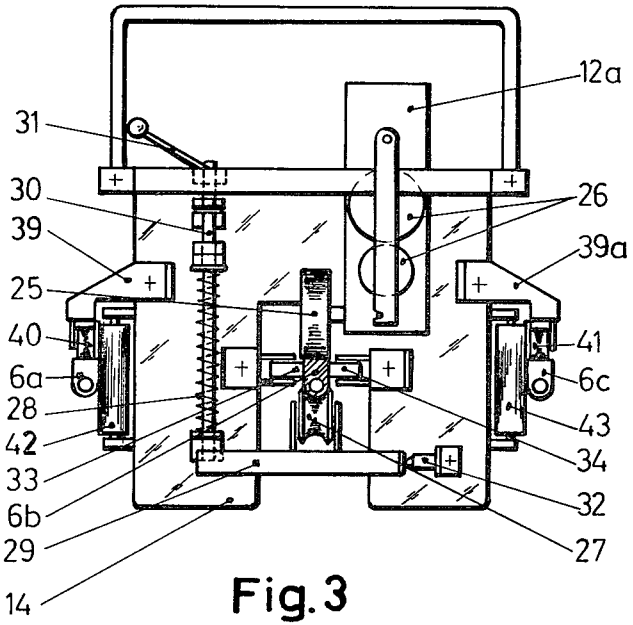
FIG. 3 is a rear elevational view of the serving device of the apparatus of FIG. 1.

A counter roller 27 is arranged opposite to the advancing roller 25 across the respective convolution 6*b*, which counter roller 27 is urged by a helical spring 28 from below toward the external surface of the respective convolution 6*b* of the induction coil 6. In the illustrated embodiment, the counter roller 27 is mounted on a pivotable lever 29 for pivoting therewith about a vertical pivot axle 30, using a handle 31 for achieving the pivotal displacement of the lever 29. In the extended position illustrated particularly in FIGS. 3 and 4, the lever 29 closes the lower open end of the slot 15 of the housing 10, which corresponds to the extended position, while in the retracted position the lever 29 is remote from the slot 15. FIG. 3 illustrates the usual operational position in which the counter roller 27 contacts the lower external surface of the respective convolution 6*b*. When the serving ring 18 is to be temporarily stopped, for instance in order to let the radially outwardly extending cooling water connectors 7 pass through the serving device 9 (see FIG. 6), with the slots of the housing 10 and of the serving ring 18 in alignment with one another, it is also necessary to pivotally displace the lever 29 out of the extended position illustrated in FIG. 3 in a lateral direction. Immediately after the cooling water connectors 7 have moved past the region of the slots of the housing 10 and of the serving ring 18, the lever 29 is pivoted back into the extended position in which it is arrested by means of a latch 32.

In addition to what has been described above, there are provided in the region of the advancing roller 25 and of the counter roller 27 guiding rollers 33, 34 arranged laterally of the respective convolution 6*b*, which guiding rollers 33 and 34 embrace between themselves the respective convolution 6b from axially lateral sides thereof.

The reference numeral 35 identifies a further guiding unit which is arranged frontwardly of the housing 10 when considered in the advancement direction Z, the guiding unit 35 being mounted on the advancing carriage 11 for adjustment of its position relative to the carriage 11. The guiding unit 35 is equipped with three additional rollers 36, 37 and 38, of which the upper roller 36 has a horizontal axis of rotation and serves as an additional support roller, and the two lateral rollers 37 and 38 have approximately vertical rotation axes and serve the purpose of an additional lateral guiding of the serving device 9.

In order to prevent any angular displacement of the housing 10 relative to the respective convolution 6b during the serving operation, the housing 10 or the carriage 11 are further supported on the immediately adjacent convolutions 6*a* and 6*c* of the induction coil 6. Auxiliary support rollers 40 and 41, seen particularly clearly in FIG. 3, serve this purpose, the rollers 40 and 41 being mounted on brackets 39 and 39*a* for free rotation. As seen in FIG. 1, the rollers 40 and 41 are situated approximately in the region of the plane of rotation of the serving ring 18. In addition thereto, additional distancing or spreading rollers 42 and 43 having vertical axes are mounted next to the support rollers 40 and 41, which spreading rollers 42 and 43 axially spread the immediately adjacent convolutions 6*a* and 6*c* away from the respective convolution 6*b* in order to permit the housing 10 or the serving device 9 to advance relative to the respective convolution 6b. The spreading rollers 42 and 43 further serve the purpose of avoiding any damage to the convolutions 6a to 6*g* of the induction coil 6.

As will be easily ascertained from FIG. 2 in connection with the above explanation, the respective convolution 6*b* is moved away from the previous convolution 6a by the action of the spreading roller 42, and the next-following convolution 6*c* is spread apart from the respective convolution 6*b* by the spreading roller 43, the convolutions 6*b* and 6*c* moving in the rightward direction relative to the convolution 6a. On the other hand, once the respective convolution 6b has been served with the protective band 24, and the serving device 9 serves the protective band 29 on the next-following convolution 6*c*, the previously served convolution 6*b* is pressed by the spreading roller 42 against the convolution 6*a*, thus reassuming the original tight configuration of the induction coil 6. On the other hand, the spreading roller 43 achieves the automatic spreading of the gap between the respective one and the next-following one of the convolutions 6*b* to 6*g* in the direction of the longitudinal axis of the driving roller 2, and particularly towards its free end, so that the housing 10 is located at the left end of the induction coil 6 and adjacent to the support 1 after the termination of the serving operation while the served convolutions 6*a* to 6*g* are situated to the right of the housing 10 and are pressed against one another.

It will be apparent that, in order to insure a proper operation of the driving roller 2, the axial length thereof between the support 1 and the flange 5 will have to at least equal the axial length of the induction coil 6 augmented by the axial dimension of the serving device 9, that is, the distance between the axially outer surfaces of the spreading rollers 42 and 43.

Under certain circumstances, for instance, when induction coils 6 the convolution 6*a* to 6*g* of which have a substantial cross-sectional area, while the induction coil 6 has a relatively small diameter are to be served, it is possible even though not absolutely necessary to facilitate the axial spreading of the convolutions 6*a* to 6*g* by means of simple non-illustrated guiding rollers which can be mounted on the support 1.

Figure 7:
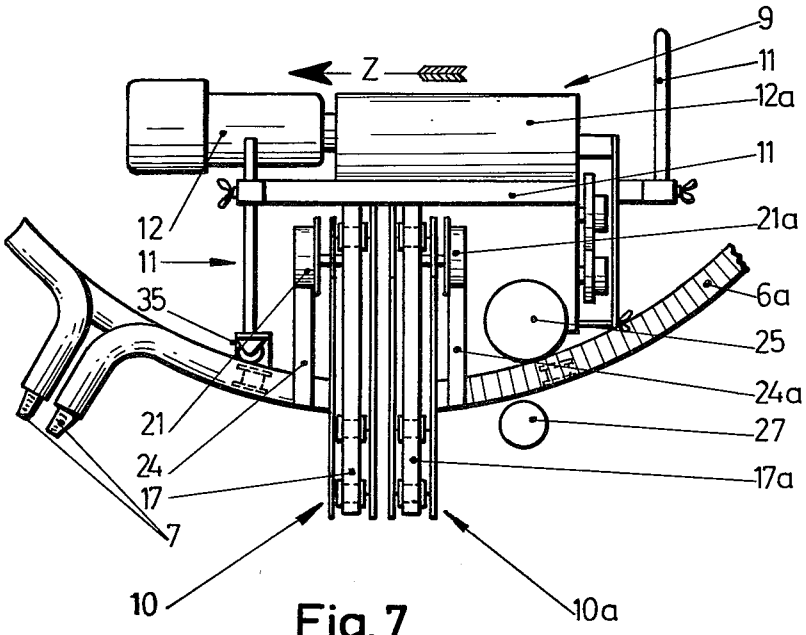
FIG. 7 is a side elevational view of a modified serving device of the apparatus of FIG. 1.

The modified spreading device of FIG. 7 differs from that of FIG. 4 mainly in the fact that two housings 10 and 10*a* are arranged in the center of the serving device 9 or of the carriage 11 thereof between the rear advancing roller 25 and the front guiding unit 35. In this arrangement, the serving ring 18 which is supported in the housing 10 which is arranged ahead of the housing 10a as considered in the direction Z, carries a reel 21 with a protective band 24 of, for instance, a synthetic plastic material, while the serving ring 18 which is supported in the rear housing 10*a* carries a reel 21*a* accommodating a protective band 24*a* of, for instance, fiberglass fabric. In this manner, the respective convolution 6*b* is served first with the synthetic plastic material band 24 and immediately thereafter with the fiberglass material 24*a* during the passage of the convolution 66 through the serving device 9.

Figure 8:
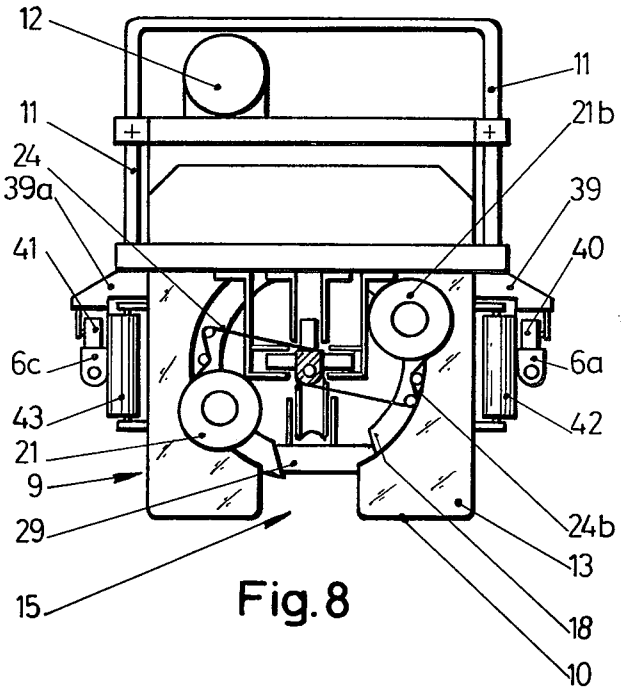
FIG. 8 is a front elevational view of a further modification of the serving device of the apparatus of FIG. 1.

In the modification of the present invention which is illustrated in FIG. 8, the serving device 9 includes only a single housing 10, but the serving ring 18 which is mounted in the housing 10 for rotation is provided at its front region, as considered in the direction Z of advancement of the serving device 9, with two reels 21 and 21*b* which are distributed through 180° about the serving ring 18. The two reels 21 and 21*b* can accommodate bands of the same, for instance, electrically insulating, material, but it is equally possible to accommodate bands of different materials on each of the reels 21 and 21*b*. So, for instance, a band 24 of synthetic plastic material may be accommodated on the reel 21, and a band 24*b* of fiberglass fabric can be accommodated on the reel 21*b*. In this manner, the convolutions 6*a* to 6*g* are served almost simultaneously with the two bands 24 and 24*b*, only at locations which are spaced from one another through an angle of 180°.

It will be understood that each of the elements described above, or two or more together, may also find a useful application in other types of constructions differing from the types described above.

While the invention has been illustrated and described as embodied in a method and apparatus for serving protective bands on convolutions of an induction coil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims:

1. A method of serving helical induction coils of large diameters and including a multitude of axially adjacent convolutions with at least one protective band using a serving device of the type including a housing having an advancement axis, a serving ring mounted on the housing for rotation about the advancement axis, and at least one payout reel for the protective band mounted on the serving ring for shared rotation therewith about the advancement axis and also for individual rotation about a support axis radially offset from the advancement axis, the method comprising the steps of mounting the induction coil for rotation about a coil axis so that the latter extends substantially horizontally; supporting the housing on an inner surface of a respective convolution to be served and at a lowermost region of the induction coil so that the advancement axis coincides with the elongation of the respective convolution; setting the induction coil in rotation about the coil axis so that the respective convolution advances at a predetermined speed in a predetermined longitudinal direction; rotating the serving ring about the advancement axis so that the protective tape is paid out from the payout reel and served onto the respective convolution; and advancing the housing in the direction of the advancement axis at substantially the same speed as but in an opposite direction than those of the respective convolution.

2. A method as defined in claim 1; and further comprising the step of spreading the convolutions which are immediately axially adjacent to the respective convolutions away from the latter to an extent necessary for the advancement of the housing along the respective convolution.

3. A method as defined in claim 2, wherein said spreading step includes contacting spreading portions of the housing with the adjacent convolutions.

4. A method as defined in claim 1; and further comprising the step of additionally supporting the housing on the convolutions of the induction coil which are axially adjacent to the respective convolution to thereby avoid angular displacement of the housing about the respective convolution.

5. A method as defined in claim 1, wherein said setting step includes suspending the coil from a substantially horizontal driving roller; and driving the driving roller into rotation to thereby frictionally entrain the induction coil and set the same into rotation about the coil axis.

6. A method as defined in claim 5; and further comprising the step of coordinating the speed of rotation of the driving roller with the speed of advancement of the housing to thereby maintain the housing substantially diametrally opposite to the driving roller during the serving operation.

7. A method as defined in claim 1, wherein at least some of the convolutions have radially extending projections; wherein both the housing and the serving ring have radially extending slots; and further comprising the step of temporarily stopping the rotation of the serving ring in a coextensive position of the slots at the region of the respective radially extending projection to let the latter pass through the slots during the advancement of the housing past the same.

8. An apparatus for serving helical induction coils of large diameters and including a multitude of axially adjacent convolutions with at least one protective band, comprising a support; a driving roller mounted on said support for rotation about a substantially horizontal axis and operative for suspending the induction coil therefrom with the coil axis of the latter being substantially parallel to said axis of said driving roller, and in contact of the circumferential surface of the driving roller with the inner surfaces of the convolutions of the induction coil; and a serving device including a housing supported on the inner surface of at least a respective one of the convolutions at a region substantially diametrally opposite of the induction coil to the driving roller, for advancement in the longitudinal direction of the respective convolution.

9. An apparatus as defined in claim 8, wherein said housing has a dimension in the direction of the coil axis; and wherein said driving roller has an axial dimension which at least equals the axial dimension of the induction coil augmented by said dimension of said housing.

10. An apparatus as defined in claim 8, wherein said circumferential surface of said driving roller has such properties that the convolutions of the induction coil can slide thereover in the axial direction of the driving roller with minimum friction, while the convolutions are frictionally entrained by the circumferential surface of the driving roller for movement herewith with minimum slippage.

11. An apparatus as defined in claim 10, wherein said driving roller includes a roller body, and a layer of friction-enhancing material at the external surface of the roller body and having said circumferential surface.

12. An apparatus as defined in claim 11, wherein said friction-enhancing material is rubber.

13. An apparatus as defined in claim 11, wherein said friction-enhancing material has a Shore hardness of approximately 60.

14. An apparatus as defined in claim 8, wherein said driving roller is of a cylindrical configuration.

15. An apparatus as defined in claim 8, wherein said axis of said driving roller is exactly horizontal.

16. An apparatus as defined in claim 8, wherein said driving roller has a first end mounted on said support, and a second end remote from said support; and wherein said driving roller further includes an abutment portion at said second end extending radially outwardly beyond said circumferential surface and preventing the induction coil from slipping off the driving roller.

17. An apparatus as defined in claim 8, wherein said serving device further includes an advancing carriage connected to said housing, an advancing roller in contact with the respective convolution on which said housing is supported behind the latter when considered in the direction of advancement of said serving device relative to said respective convolution, and means for driving said advancing roller in rotation, including a motor mounted on said carriage.

18. An apparatus as defined in claim 17, wherein said advancing roller has a layer of friction-enhancing material at least at the outer circumferential surface thereof.

19. An apparatus as defined in claim 17, wherein said serving device further includes a counterroller, and means for mounting said counterroller opposite to said advancing roller across said respective convolution.

20. An apparatus as defined in claim 19, wherein said driving means also drives said counterroller.

21. An apparatus as defined in claim 19, wherein said serving device further includes a support lever and means for supporting said support lever on said housing for displacement between an extended and a retracted position; and wherein said mounting means so mounts said counterroller on said support lever for displacement therewith that said counterroller is opposite to said advancing roller in said extended position, and remote from said respective convolution in said retracted position.

22. An apparatus as defined in claim 21, wherein said serving device further includes at least one spring urging said lever toward said extended position thereof.

23. An apparatus as defined in claim 21, wherein said supporting means mounts said lever on said serving device for pivoting about a substantially vertical axis.

24. An apparatus as defined in claim 23, wherein said housing has a downwardly open elongated slot; and wherein said lever has a portion which closes the open end of said slot in said extended position, and opens the same in said retracted position.

25. An apparatus as defined in claim 17, wherein said serving device further includes a pair of guiding rollers mounted on said advancing carriage and contacting said respective convolution at axially spaced lateral surfaces thereof.

26. An apparatus as defined in claim 17, wherein said serving device further includes a guiding carriage located before said housing when considered in the direction of advancement of said serving device relative to said respective convolution, and a pair of additional guiding rollers mounted on said guiding carriage and contacting said respective convolution at axially spaced lateral surfaces thereof.

27. An apparatus as defined in claim 8, wherein said serving device further includes a serving ring, means for mounting said serving ring on said housing for rotation about an advancement axis of the housing and about said respective convolution, and means for preventing angular displacement of said housing about said respective convolution, including auxiliary support rollers, and means for mounting said auxiliary support rollers on said housing for rotation in contact with the convolutions of the induction coil which are immediately axially adjacent to said respective convolution.

28. An apparatus as defined in claim 27, wherein said auxiliary support rollers are arranged in a plane normal to said advancement axis.

29. An apparatus as defined in claim 27, wherein said serving device further includes a pair of spreading rollers mounted on said housing next to said auxiliary support rollers and having vertically extending roller axes, which spreading rollers contact the axial lateral surfaces of the convolutions of the induction coil which are immediately adjacent to said respective convolution and urge such convolutions away from said respective convolution.

30. An apparatus as defined in claim 29, wherein said auxiliary support rollers and said spreading rollers are arranged approximately in a plane which is normal to said advancement axis and passes through said serving ring.

31. An apparatus as defined in claim 8, wherein said serving device further includes a serving ring, means for mounting said serving ring on said housing for rotation about an advancing axis of said housing and about said respective convolution, and means for driving said serving ring into rotation about said advancement axis.

32. An apparatus as defined in claim 31, wherein said driving means includes an endless belt trained about the outer periphery of said serving ring.

33. An apparatus as defined in claim 31, wherein said serving device further includes at least one payout reel accommodating a supply of the protective band and means for mounting said payout reel on said serving ring for shared rotation therewith about said advancement axis and also for individual rotation about a support axis radially offset from said advancement axis.

34. An apparatus as defined in claim 33, wherein said serving device further includes at least one auxiliary guiding roller mounted on said serving ring for shared rotation therewith about said advancement axis and cooperating with said payout reel to guide the protective band onto said respective convolution.

35. An apparatus as defined in claim 34, wherein said serving device further includes an additional payout reel and at least one additional auxiliary guiding roller similar to said payout reel and to said auxiliary guiding roller, respectively, and mounted on said serving ring in a similar manner at the same axial side thereof but circumferentially offset from said payout reel and auxiliary guiding roller through 180° about said advancement axis.

36. An apparatus as defined in claim 35, wherein said additional payout reel accommodates a supply of an additional protective band of the same material as the protective band.

37. An apparatus as defined in claim 35, wherein said additional payout reel accommodates a supply of an additional protective band of a different material from that of the protective band.

38. An apparatus as defined in claim 33, wherein said serving device includes an additional housing similar to said housing, an additional serving ring similar to said serving ring, means for so mounting said housing and additional housing coaxially as considered in the direction of the advancement of said serving device relative to said respective convolution that said payout reel is arranged at an axial side of said serving ring which faces away from said additional serving ring, an additional payout reel similar to said payout reel and accommodating an additional supply of a protective band, and means for mounting said additional payout reel at a side of said additional serving ring which faces away from said serving ring.

39. An apparatus as defined in claim 38, wherein said bands are of the same material.

40. An apparatus as defined in claim 38, wherein said bands are of different materials.

41. An apparatus as defined in claim 38, wherein said serving device further includes an advancing roller, an endless belt trained about the periphery of said serving ring, and a motor which synchronously drives said advancing roller and said endless belt.

42. An apparatus as defined in claim 41, wherein said serving device further includes a transmission interposed between said motor and said advancing roller.

43. An apparatus as defined in claim 41, wherein said transmission includes meshing gear pairs which can be easily replaced by other meshing gear pairs to thereby vary the advancement speed of said serving device.

* * * * *